US005259913A

United States Patent [19]

Stover

[11] Patent Number: 5,259,913

[45] Date of Patent: Nov. 9, 1993

[54] CONTINUOUS ROTARY LABELING APPARATUS AND METHOD

[75] Inventor: Jeffrey D. Stover, Hamilton, Ohio

[73] Assignee: Spear, Incorporated, Mason, Ohio

[21] Appl. No.: 965,184

[22] Filed: Oct. 23, 1992

[51] Int. Cl.[5] ..... B65C 9/00

[52] U.S. Cl. ..... 156/566; 156/447; 156/567; 156/571; 156/DIG. 26

[58] Field of Search ..... 156/446, 447, 448, 449, 156/566, 567, 570, 571, DIG. 11, DIG. 26; 198/377, 378

[56] References Cited

U.S. PATENT DOCUMENTS

| | | | |
|---|---|---|---|
| 3,064,714 | 11/1962 | Flood . | |
| 3,653,176 | 4/1972 | Gess . | |
| 3,718,517 | 2/1973 | Berg . | |
| 4,806,197 | 2/1989 | Harvey | 156/449 |
| 4,994,135 | 2/1991 | Orlandi | 156/567 X |
| 5,028,293 | 7/1991 | Harvey | 156/449 |

FOREIGN PATENT DOCUMENTS 667473 7/1963 Canada .

*Primary Examiner*—David A. Simmons

*Assistant Examiner*—James J. Engel, Jr.

*Attorney, Agent, or Firm*—Frost & Jacobs

[57] ABSTRACT

A rotary decorating machine for bottles having an alignment structure formed adjacent their bottom periphery, wherein the machine has at least one decorating station. A rotating table is provided with a plurality of independently rotatable bottle receiving cups spaced from one another adjacent the outer periphery of the table. The rotating table is driven by a first motor, and the bottle receiving cups are independently rotatable by pinion gears attached thereto for enabling planetary rotation of the bottles relative to the rotating table. A lower gear is provided with a second drive motor for rotation independent of the rotating table, and the pinion gears attached to individual bottle receiving cups are intermeshed with that gear. Rotation of the lower gear independently effects the rotation speed and direction of the bottle receiving cups independent of the planetary rotation resulting from movement of the rotating table. A control device is further provided for implementing instructions to the second drive motor to effectively control the rotation of the bottle receiving cup relative to the rotation of the rotating table during labeling operations.

25 Claims, 9 Drawing Sheets

CONTINUOUS ROTARY LABELING APPARATUS AND METHOD

TECHNICAL FIELD

This invention relates to rotary decorating machines for bottles and the like, and, more particularly, to an improved continuous rotary labeling apparatus and method for automatically applying pressure sensitive labels, wherein a wide variety of container sizes and decorating application requirements can be easily and quickly accommodated in a continuous manner, and wherein the drive assembly of the machine can provide a variety of bottle spin rates and production speeds automatically and without a need for any physical interchange of parts.

BACKGROUND ART

Over the years there have been a number of rotary-type labeling and decorating machines designed to accommodate various tubular or cylindrical items such as bottles, cans, jars and the like on a continuous basis. In this regard, rotary-type application arrangements have been relatively widely known for continuous operations, wherein articles to be decorated are situated about the periphery of a rotating wheel and successfully moved past one or more label applicating or other decorating stations.

It has also been common to provide holders for individual bottles or the like adjacent the periphery of the rotating wheel, wherein each of the bottle holders is rotatably held adjacent that periphery. Each holder device is further non-rotatably connected to a pinion gear which is meshed with the periphery of a stationary gear, such that as the rotating wheel or table moves the individual bottle holder devices about its periphery, the pinion gears moving about the stationary gear cause planetary type rotation of the holder devices relative to the rotating table.

An example of a planetary type arrangement is shown in U.S. Pat. No. 4,806,197, which issued to A. Harvey. The Harvey continuous motion round bottle turret arrangement provides rotational energy via a shaft and drive sprocket, wherein the individual receptacle cups are turned by a preselected angle as a result of the planetary interaction of the gears 302 and 303. Harvey also contemplates bottle engaging cups having an internal plate which is raised up to accept a bottle from a conveyor belt as a result of its plate stem interacting with a CAM surface therebelow. Generally, however, planetary type arrangements of this type, and of the type commonly available in the industry, include the inherent physical connection between bottle supporting devices and the rotating table. In order to speed up the rotation of the individual bottles, it is necessary to speed up the entire continuous motion system, and the rotating table in particular. Moreover, to adapt the system to bottles having varying external diameters, shapes, sizes or decoration requirements, it is necessary to physically dismantle a substantial portion of the labeling machinery to substitute planetary gears and other parts of corresponding sizes, diameters, etc. These physical limitations can cause substantial down time for labeling machinery used for decoration of products of varying dimensions and designs, and made the notion of quickly interchangeable or universal labeling machines essentially unattainable heretofore.

Other examples of machinery and procedures previously available in the labeling and decorating industry, including U.S. Pats. 3,064,714 (which issued to C. Flood), 3,653,176 (which issued to L. Gess), 3,718,517 (which issued to T. Berg), and Canadian patent 667,473 (which also issued to C. Flood), have many of these same limitations, and generally require substantial part interchange or other physical modification to adapt such machinery to differing label applications or decorating requirements. Consequently, heretofore there has not been available a continuous labeling machine and process which would enable convenient and relatively automatic transition among a variety of label applicating and/or decorating schemes without unwieldy, costly, and/or inconvenient part change requirements. Due to these technological and practical limitations, most continuous bottle labeling/decorating machines were necessarily provided in a dedicated or semi-dedicated environment, where transitions between product designs and labeling requirements were necessarily maintained as rare occurrences due to the costs, time, and skilled labor requirements.

DISCLOSURE OF THE INVENTION

It is an object of the present invention to obviate the above-described problems and shortcomings of labeling a decorating apparatus and methods heretofore available in the industry.

It is another object of the present invention to provide an improved continuous rotary labeling apparatus and method which can effectively duplicate a number of various and distinct gear ratio arrangements quickly and automatically and without necessitating physical substitution of gears or other parts.

It is yet another object of the present invention to provide an improved continuous rotary labeling apparatus which is automatically adaptable to a variety of bottles or similar articles of varying shapes, sizes, and decorating requirements without requiring substantial interchange of physical structures or parts of the apparatus.

It is also an object of the present invention to provide an effectively universal, continuous rotary labeling apparatus and method which can be preprogrammed to automatically adjust between applications to accommodate a number of distinct types of bottles or similar articles having various labeling and/or decorating requirements.

It is yet another object of the present invention to provide an improved continuous rotary labeling apparatus which includes adaptable bottle holding cup assemblies having adjustable detent means for automatically establishing predetermined registration of bottles therewithin and which can accommodate bottles of sizes, shapes and diameters within a predetermined varying range.

In accordance with one aspect of the present invention, there is provided a rotary decorating machine for bottles having an alignment recess formed adjacent their bottom periphery, and wherein the machine has at least one decorating station. A rotating table is provided with a plurality of independently rotatable bottle receiving cups spaced from one another around the outer periphery of the table. The rotating table is driven by a first motor, and the bottle receiving cups are rotatable by pinion gears attached thereto for enabling planetary rotation of the bottles relative to the rotating table. A lower gear is provided with a second drive motor for rotation independent of the rotating table, and the pinion gears attached to individual bottle receiving cups are intermeshed with that gear. Rotation of the lower gear independently affects the rotation speed and direction of the bottle receiving cups independent of the planetary rotation resulting from movement of the rotating table. A control device is further provided for implementing instructions to the second drive motor to effectively control the rotation of the bottle receiving cup relative to the rotation of the rotating table during labeling operations.

In a preferred embodiment, the second drive motor is provided in the form of a servo motor connected directly to the lower gear. Feedback concerning the relative positions of the rotating table and the individual bottle holding cups is provided to the control device, whereby rotational movement of the lower gear is adjusted as appropriate for maintaining desired rotation and registration of bottles held within the bottle holding cups adjacent one or more decorating stations. In a preferred embodiment, user control of the location and spin rate of the individual bottle holder cups is achieved through a user interface such as a touch screen or keypad and a computer for running preprogrammed decorating procedures. The individual bottle receiving cups further preferably comprise an adjustable biased detent device which corresponds with the alignment recess on the individual bottles to maintain the bottle in a predetermined orientation within the cup. The labeling apparatus is further provided with a bottle orienting assembly which automatically aligns the cup detent with the alignment recess in the bottle following placement of the bottle within the receiving cup. The biased detent provides both predetermined orientation of the bottle and automatic adjustability for varying bottle diameters.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

DETAILED DESCRIPTION OF THE INVENTION

Figure 1:
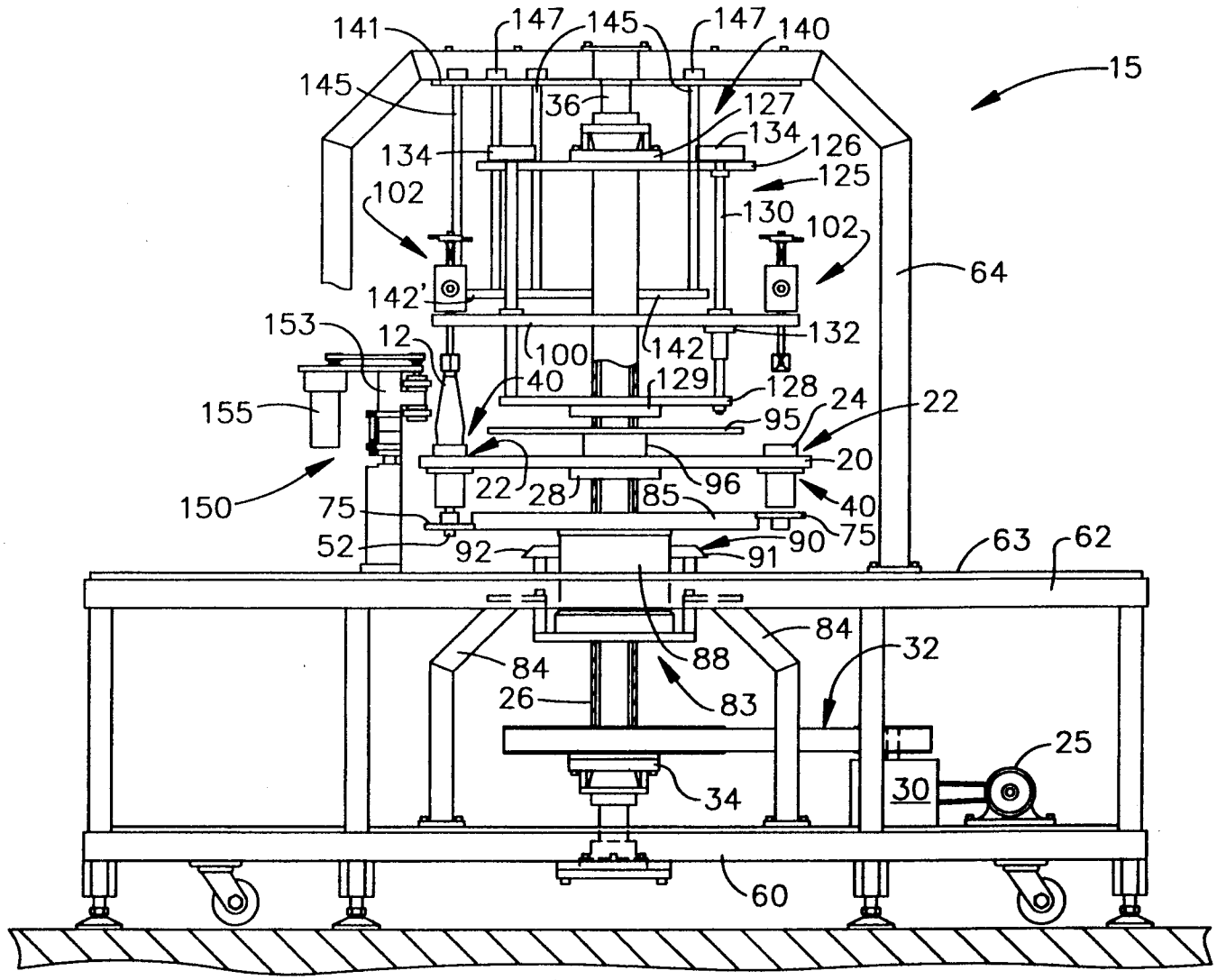
FIG. 1 is a partial, broken out, front elevational view of a continuous rotary labeling apparatus made in accordance with the present invention.

Referring now to the drawings in detail, wherein like numerals indicate the same elements throughout the views, FIG. 1 is a partial front elevational view of a continuous rotary labeling/decorating apparatus 15 made in accordance with the present invention, wherein portions of this machine have been omitted and/or broken out for simplification and clarity. Particularly, the labeling apparatus and method of the present invention is directed to labeling and decorating machines for relatively cylindrical objects such as bottles, cans, jars and the like (hereinafter sometimes jointly referred to as "bottles"), and includes particular adaptations most effective for reliable and repeatable continuous labeling of bottles (e.g., 12) having upper neck portions (e.g., 13) and an alignment structure (e.g., recess 14) or registration dimple provided adjacent a closed lower end. Such registration dimples or similar structures are often provided to interact with other detent means in order to facilitate registration of pressure sensitive labels, silk-screening, or the like at one or more decorating stations (e.g., decorating station 17 and 18 of FIG. 2).

Figure 2:
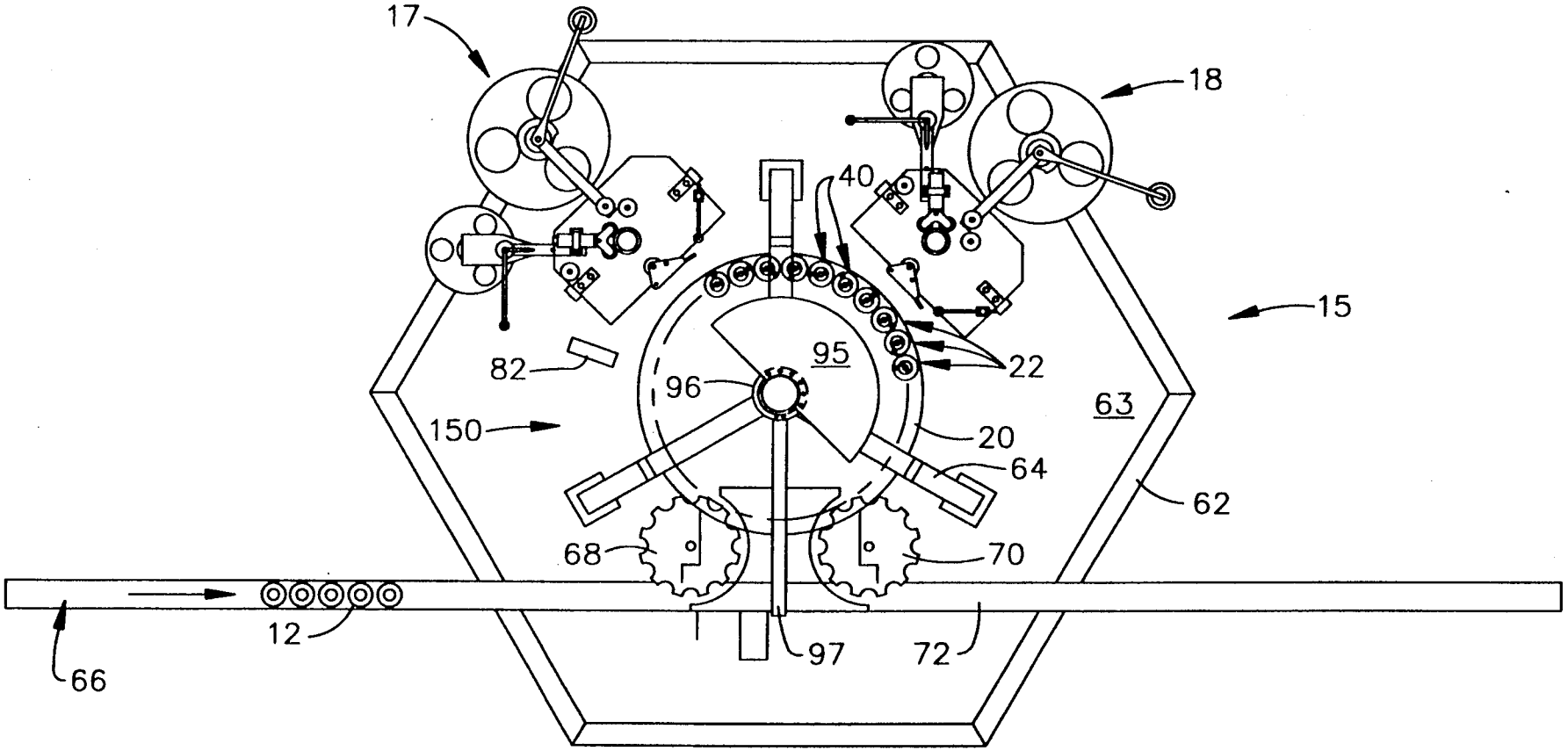
FIG. 2 is a partial top plan view of the apparatus of FIG. 1, illustrated in partially schematic form and with the upper portions of such labeling apparatus removed for clarity.

Considering FIGS. 1 and 2 together, rotating decorating machine 15 is illustrated as including a rotating table 20 having a plurality of bottle receiving locations 22 spaced from one another about the periphery of table 20. At each of these bottle receiving locations 22, a cup assembly receiving opening 24 is provided in which an independently rotatable cup assembly or bottle receiving cup 40 will be rotatably mounted. Rotating table 20 is illustrated as being effectively rigidly attached to a hollow drive shaft 26, such as via a connecting collar 28, for rotatable movement therewith. Drive shaft 26 is rotatably mounted on support shaft 36, which is rigidly supported between lower frame 60 and the upper portions of overhead support frame 64. It is contemplated that drive shaft 26 would be appropriately mounted on thrust bearings or the like for substantially frictionless rotation on support shaft 36. Drive motor 25 provides rotational movement to shaft 26, such as via transmission/gear box 30, pulley/drive belt arrangement 32, and drive collar 34.

Wiper plate mount 95 is illustrated in FIGS. 1 and 2 as being non-rotatably attached within decorating machine 15 via a collar 96 supported on cantilevered support bar 97, which is separately attached to upper frame 62. This stationary wiper plate mount provides for selective use of auxiliary wipes and the like, and must be provided in a non-rotating arrangement.

Figure 3:
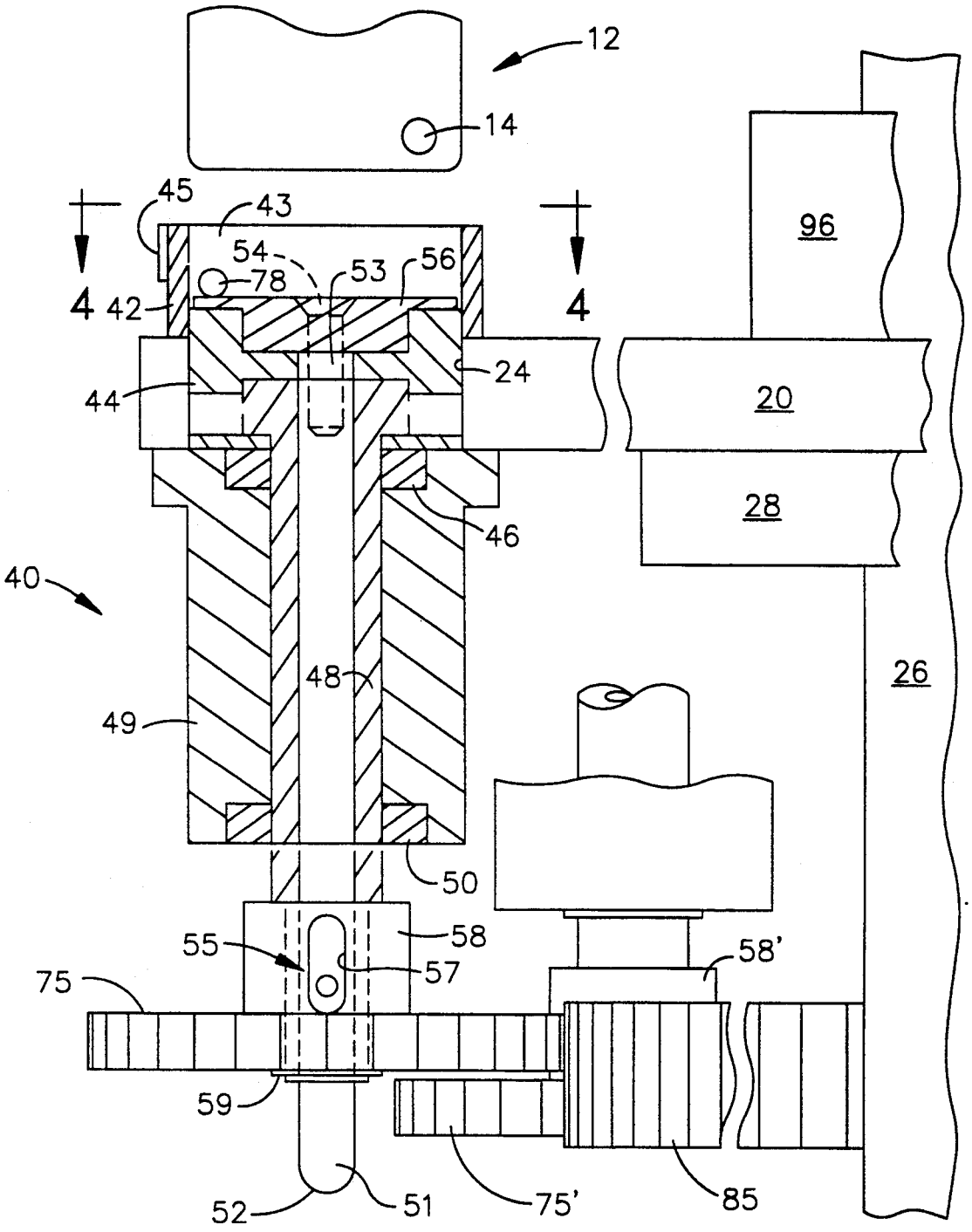
FIG. 3 is a partial, enlarged cross-sectional view of a preferred embodiment of the bottle receiving cup assembly of the present invention.
Figure 4:
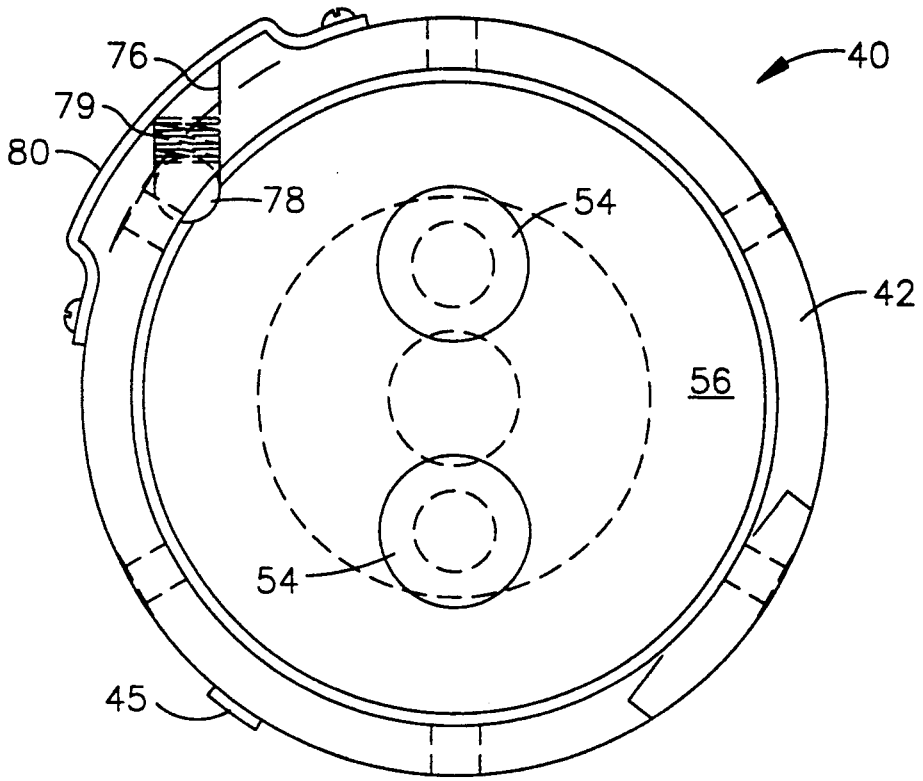
FIG. 4 is an enlarged, partial top plan view of the cup assembly of FIG. 3.

Turning now to the details of FIGS. 3 and 4, the independently rotatable cup assembly 40 is illustrated as preferably comprising a bottle receiving recess 43 defined by a cup sleeve 42 and cup base 44, which are preferably rigidly attached to a downwardly depending hollow sleeve 48. Sleeve 48 is rotatably mounted within bearing block 49 via a pair of spaced bearings 46 and 50, respectively. It is contemplated that bearing block 49 will be non-rotatably attached to the lower portions of rotating table 20 via bolts or the like (not shown). The lower portions of sleeve 48 are illustrated as having a reduced outer diameter for telescopingly receiving a spacer 58 and a pinion gear 75. For manufacturing simplicity, sleeve 48 will most likely be a separate piece rigidly connected to cup base 44, which in turn will be connected rigidly with cup sleeve 42 for rotational movement with pinion gear 75. The external teeth of gear 75 mesh with corresponding teeth of a lower gear 85 separately provided with rotary decorating machine 15. As seen best in FIG. 3, adjacent pinion gears 75 may preferably be staggered on lower gear 85 (e.g., vertically staggered) to minimize the required space between adjacent rotatable cup assemblies 40 spaced around table 20.

Through the center of the rigidly connected combination of pinion gear 75, spacer 58, sleeve 48, and cup base 44, preferably extends a reciprocable dowel pin 51, which is rigidly connected at its upper end (e.g., 53) via one or more screws 54, to a bottle support pad 56. Pin 51 is axially reciprocable within sleeve 48 to alternately move bottle support pad 56 upwardly to enable placement of the lower surface of a bottle 12 thereon substantially outside of recess 43 at a bottle loading station (e.g., at star wheel loading station 68 shown in FIG. 2). Once a bottle 12 is placed upon the upper surface of support pad 56, the pad and supported bottle are thereafter lowered into recess 43 by corresponding lowering of the reciprocable pin 51. As will be understood, lower tip 52 of pin 51 will selectively interact with a lower cam 90 in order to actuate the reciprocable support pad 56 as appropriate.

A longitudinal slot 57 is provided in spacer 58, wherein a dowel pin 55 is connected to reciprocable pin 51. The extension of dowel pin 55 within slot 57 and the longitudinal length L of slot 57 provides a predetermined limited length of longitudinal travel of pin 51 (and, correspondingly, support pad 56), and will be designed to accommodate the necessary vertical movement of support pad 56 to properly receive bottles and lower them into the receiving cups. An appropriate retainer or snap-ring 59 facilitates the connection between pinion gear 75 and sleeve 48.

As best seen in FIG. 4, the bottle receiving cups further preferably include a detent-like means (e.g., biased ball 78) provided for adjustably accommodating bottles of varying outer diameters adjacent their lower edges, and for selectively and lockingly maintaining a bottle 12 in a predetermined orientation relative to cup sleeve 42. In a preferred embodiment, this detent is provided in the form of a wear resistant rounded device such as a carbide ball 78, biased inwardly by a spring or resilient material (e.g., disk spring 79, which might also include a seal member to prevent foreign material from entering and/or deteriorating the biased nature of the arrangement). For ease of assembly, a dowel pin or carbide ball 78 might be inserted from the exterior of cup sleeve 42, such as via bore 76, after which a seal and/or disk spring 79 can be inserted and held in place with an external leave spring or cover 80. In this way, an automatically adjustable detent arrangement is provided which can automatically adapt to a variety of bottle diameter sizes, while ensuring smooth frictional and/or locking interaction of ball 78 with an appropriate registration protuberance or recess 14 on the bottle.

As generally shown in FIG. 2, bottles 12 to be decorated will be provided to decorating machine 15 via an in-feed conveyor (e.g., 66), a screw feed conveyor 66 for ensuring proper queuing of the bottles, and an inlet star wheel arrangement 68 for serially feeding individual bottles onto an upwardly extended bottle support pad 56 of a rotatable cup assembly 40 on rotary table 20. Thereafter, rotating table 20 successively rotates the bottles held within the individual cup holder assemblies in a clockwise manner past one or more decorating stations (e.g., 17 and 18) and eventually to outlet star wheel arrangement 70 and bottle discharge conveyor 72.

As will be appreciated, the present invention enables pinion gear 75 will provide independent rotation to bottle receiving cup sleeve 42 and a bottle 12 held therewithin. As best seen in FIGS. 1 and 3, a lower gear 85 is provided below rotating table 20, and is designed for rotation independent of rotating table 20. Particularly, in a preferred arrangement, lower gear 85 will be connected in direct drive relationship with a second means for independently driving such lower gear. This second means or independent drive motor preferably comprises a servo motor (e.g., 88) which can be provided in a hollow or doughnut shape conformation for concentric mounting about drive shaft 26. As illustrated, servo motor 88 may preferably be supported from upper frame 62 and/or via auxiliary support beams 84 extending upwardly from lower frame 60 and connected to servo motor support 83.

As will be understood, the provision of a second independent drive means for lower gear 85 enables independent rotation of lower gear 85 which directly effects the rotation speed and direction of the independently rotatably cup assemblies 40 relative to the rotation of rotating table 20. This arrangement provides complete control of the spin rate of pinion gears 75, because lower gear 85 can be moved at any speed and in either direction, thereby correspondingly increasing or decreasing the natural or planetary spin rate which would result from rotation of rotating table 20 about a stationary lower gear 85. For example, with a lower gear to pinion gear ratio of 6:1, when lower gear 85 is at rest, each pinion gear 75 (and correspondingly each bottle receiving cup) will make six full revolutions for every 360 degree movement of the pinion gears about the periphery thereof (i.e., for each full revolution of rotating table 20).

Because lower gear 85 is in no way physically rotationally dependent upon movement of rotating table 20, the effective direction and speed of the rotation of the independently rotatable cup assemblies 40 will be determined by movement of lower gear 85 during rotation of rotating table 20. It can be seen, consequently, that essentially unlimited control over the spin rate and effective gear ratios can be automatically implemented without structural changes to decorating machine 15 simply by appropriate control of lower gear 85 relative to rotating table 20. As set forth below, various spin rates and effective gear ratio relationships can be preprogrammed into a control device (e.g., host computer 184 and programmable indexer 182 shown in FIG. 9) to facilitate automatic and nearly instantaneous alternation of the operation of the present decorating machine and method.

As best seen in FIG. 1, a lower cam plate 90 is preferably provided adjacent the inlet and outlet star wheel 68 and 70, respectively, to raise and lower bottle support pad 56 of the individual cup assemblies 40 to facilitate feeding of bottles to be decorated into respective cup assemblies, and ultimate withdrawal of decorated bottles therefrom for further processing. As will be understood, as rotating table 20 revolves in a clockwise direction, lower tip 52 of reciprocable pin 51 interfaces with a tapered lead in portion 91 of lower cam 90, thereby displacing pin 51 in an upward direction and pushing bottle support pad 56 (and a bottle supported thereon) out of cup recess 43. In this way, decorated bottles are readied for removal from the decorating machine 15, such as via outlet star wheel 70. While in the upwardly extended position, a cup assembly 40 proceeds in a clockwise direction to receive an incoming bottle to be decorated via inlet star wheel 68.

Once a bottle to be decorated is placed upon the upper surface of support pad 56, and rotating table 20 continues in a clockwise direction, lower tip 52 disengages lower cam 90 such as via a tapered off ramp 92. While many bottles to be decorated will be heavy enough to automatically displace bottle support pad 56 and is reciprocable pin 51 in a downward direction, cup assembly 40 may further comprise a compression spring (not shown) or comparable arrangement which generally biases the support pad 56 in a downward direction.

Figure 5:
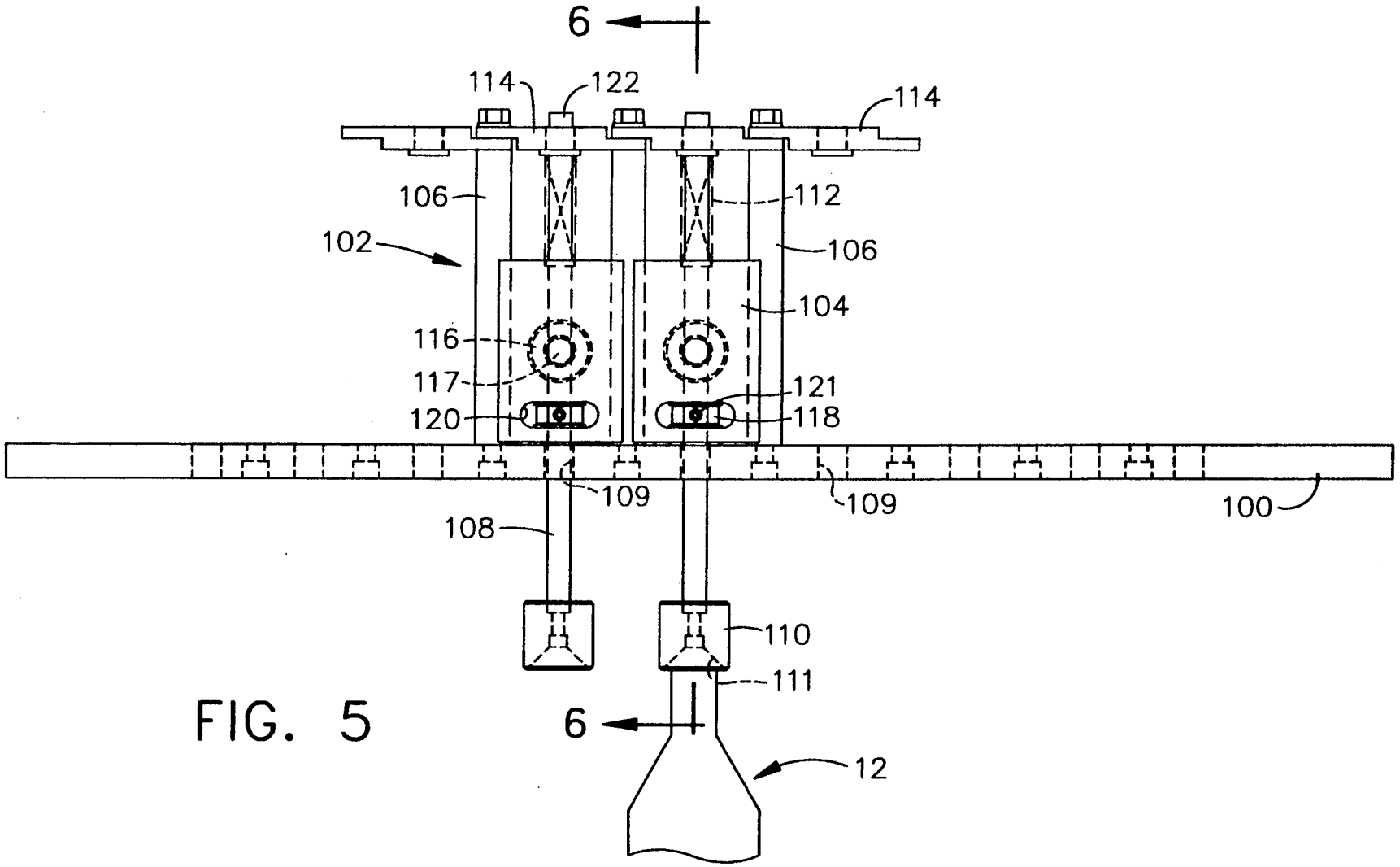
FIG. 5 is a partial, enlarged front elevational view of the upper rotary table of a preferred embodiment of the present rotary labeling apparatus.
Figure 6:
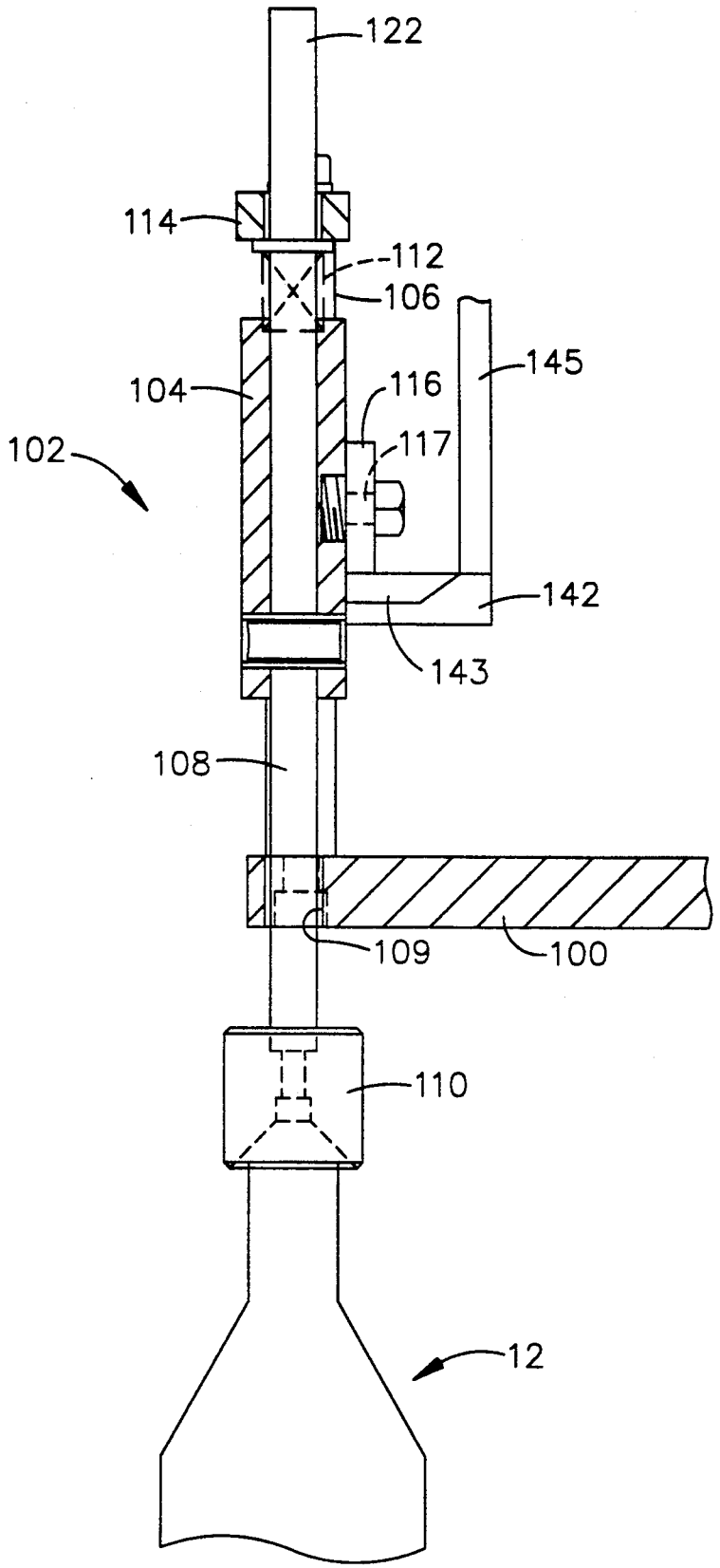
FIG. 6 is a partial vertical cross-sectional view of the nose cone assembly and cam arrangement of the upper rotary table as shown in FIG. 5, taken along line 6—6 thereof.

Because many decorating stations will require the application of pressure sensitive labels or the like, it is generally necessary to support bottles to be decorated at both their upper and lower ends. As seen in FIG. 1, an upper rotary table 100 is provided with a plurality of bottle top support assemblies (shown schematically as assemblies 102). Details of bottle top support assemblies 102 are best seen in FIGS. 5 and 6. Particularly, upper rotary table 100 comprises a substantially round or disk shaped plate connected via a rotary table adjustment assembly 125 for rotation with drive shaft 26.

Figure 7:
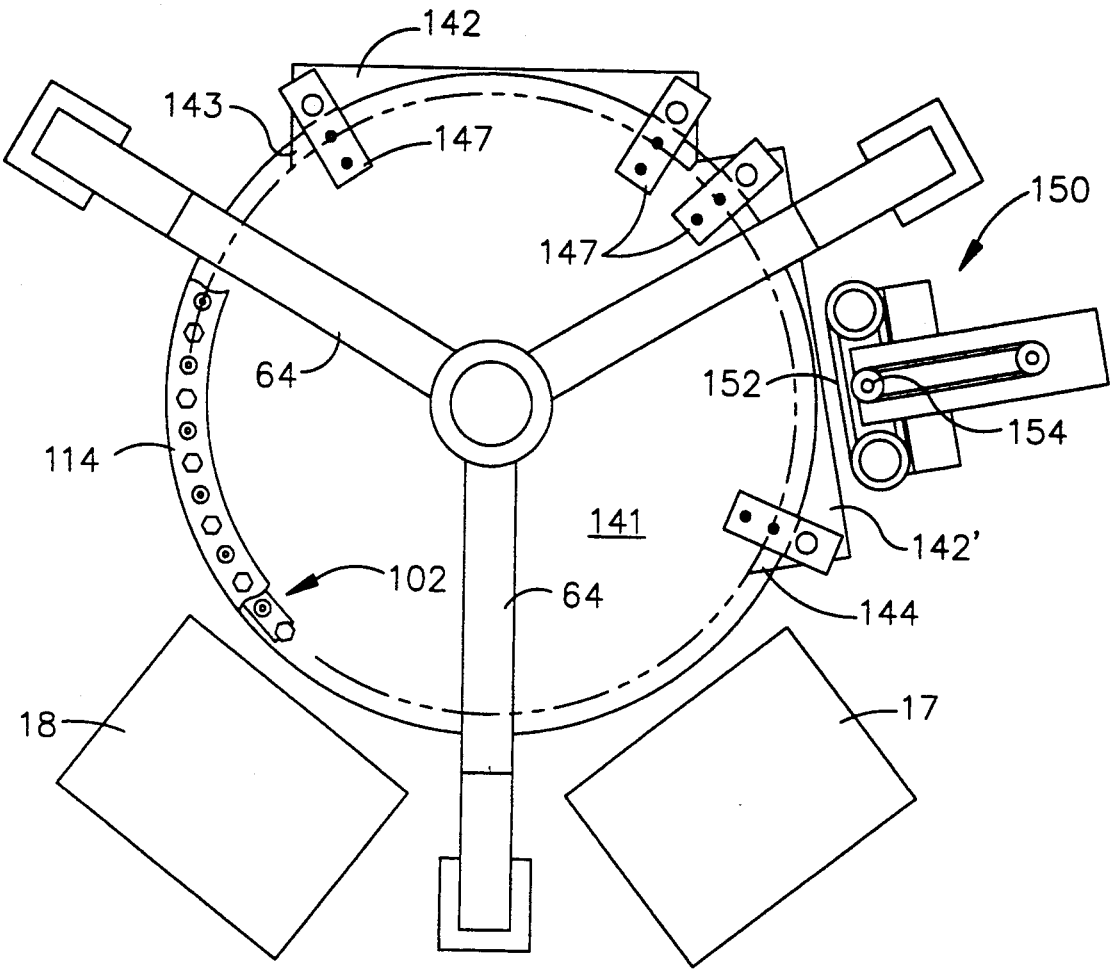
FIG. 7 is a partial top plan view of the labeling apparatus of FIG. 1, showing the top plate and upper cam attachment arrangement.

Support assembly 102 preferably comprises a block 104 slidably mounted for axial reciprocation between a pair of oppositely disposed vertical support rails 106. Block 104 supports a downwardly depending shaft 108 which extends through a bore 109 in upper table 100 and carries a bottle cap support block 110 at its lower distal end. A resilient bottle recess 111 will preferably be provided for conveniently receiving an upper edge or top of a bottle to be decorated, and will preferably have inwardly tapered portions for conveniently accepting and holding bottle tops of varying diameters. A compression spring 112 normally biases block 104 and the connected shaft 108 and cap support block 110 in a downward direction, and the upper portions of adjacent bottle top support assemblies 102 are preferably connected by a plurality of support links 114 or one or more semi-circular support rings (as seen in FIGS. 5 and 7). Block 104 is shown as being connected to shaft 108 via pin 121 installed through slot 120.

At the upper end of shaft 108, there can be provided a sensing device (e.g., sensor 122) to determine whether there is a bottle supported by bottle top support assembly 102. Particularly, a detector can be situated to determine whether sensor 122 is in a raised position (indicating the presence of a bottle), whereby if there is no bottle, no label will be supplied to the decorating station. Alternatively, sensor 122 can be utilized to indicate a problem in feeding of undecorated bottles and/or the end of a production run.

As also seen in FIGS. 6 and 7, bottle top support assembly 102 further preferably comprises a cam assembly including a cam wheel 116 rotatably supported on block 104 via a radial ball bearing 117. As can be seen in the front elevational view of FIG. 1 and the top plan view of FIG. 7, one or more upper cam assemblies 140 may be connected to depend downwardly from top plate 141 mounted adjacent the upper portions of overhead support frame 64. Upper cam assembly 140 will preferably comprise a semi-circular cam plate 142 having a tapered lead-in 143 and a tapered off ramp 144, and will depend downwardly from top plate 141 via a plurality of support rods 145. Clamps 147 connect support rods 145 to top plate 141, and cam plates 142 are arranged to selectively interact with cam wheels 116 of bottle top support assemblies 102 to raise and lower the bottle cap support block 110 to facilitate the placement and removal of bottles with respect to rotary decorating machine 15.

As will be understood, cam plate 142 will be located adjacent the front portions of decorating machine 15 adjacent the outlet star wheel 70, whereby substantially simultaneously with the raising of the bottle support pad 56 to displace a decorated bottle from the cup assembly, the corresponding bottle top support assembly 102 will also be lifted to disengage the bottle top as a result of interaction between cam wheel 116 and cam plate 142. FIG. 6 illustrates bottle top support assembly 102 in its upward condition, (i.e., disengaged condition) which would be desired adjacent the bottle outlet and inlet star wheels (e.g., 70 and 68, respectively) to facilitate removal of decorated bottles and placement of undecorated bottles relative to decorating machine 15. Once an undecorated bottle 12 is placed upon the upper surface of bottle support pad 56 and initially lowered into cup recess 43, it is desirable to initiate engagement of bottle cap support block 110 with the upper portions of the bottle. However, until the alignment recess (e.g., registration dimple 14) of bottle 12 is properly aligned with detent 78 within the cup, maximum vertical downward force of bottle top support assembly 102 may not be desired. In this regard, a second upper cam plate 142' is shown in FIGS. 1 and 7 as being located adjacent the inlet portions of decorating machine 15 in a clockwise direction.

Figure 8:
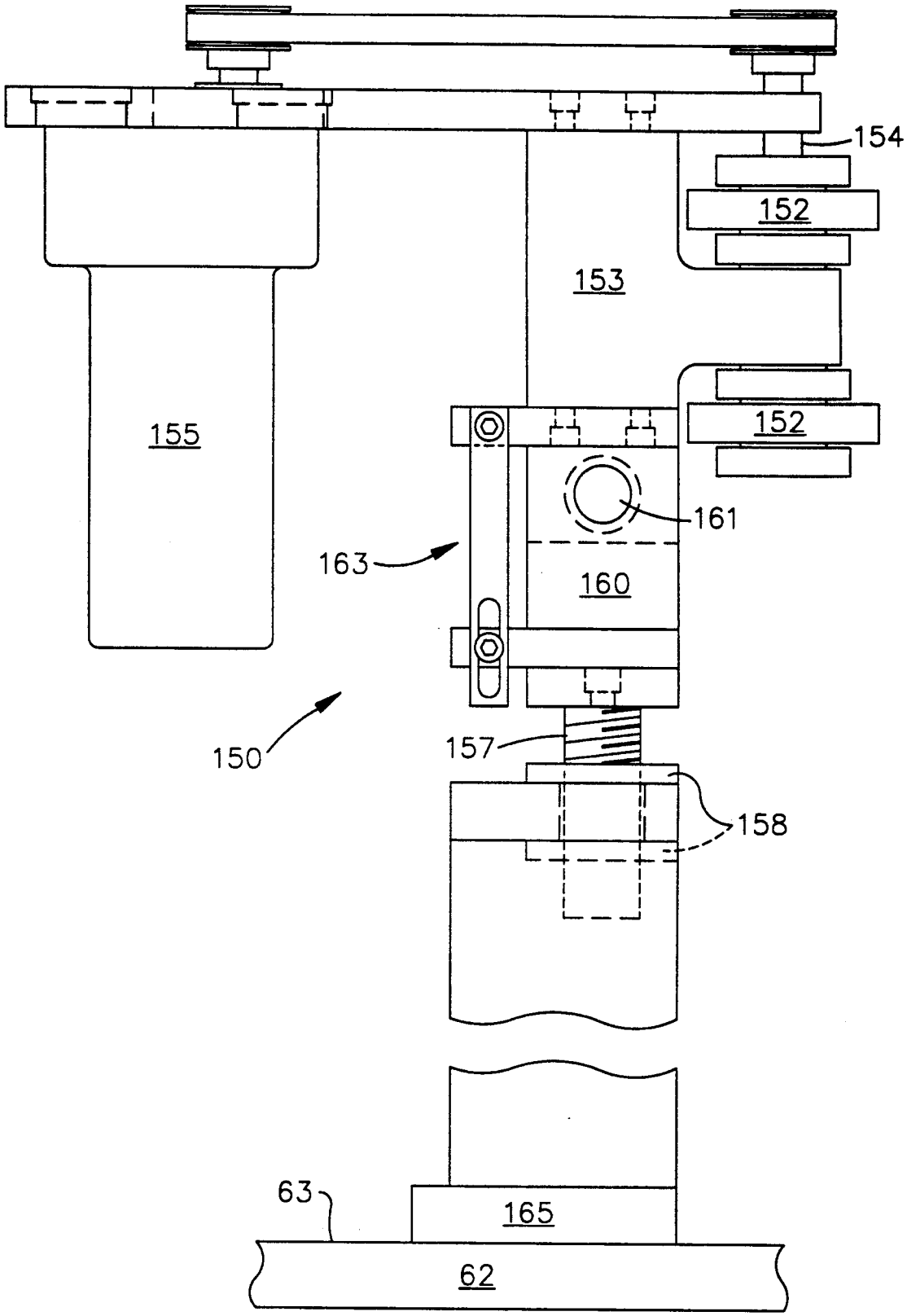
FIG. 8 is an enlarged, side elevational view of a preferred orientation assembly of the subject rotary labeling apparatus.

Once a bottle is initially located within a recess 43 of a cup holder assembly 40, it is preferred that means be provided for ensuring proper orientation of the bottle within the cup assembly. As seen in FIGS. 1, 7 and 8 an adjustable orientation assembly 150 is preferably situated adjacent the inlet area of machine 15 for providing relative rotation of a bottle 12 held partially within a cup holder recess 43 to ensure that the biased detent 78 properly engages a corresponding registration structure (e.g., recess 14) on the lower portion of the bottle. Orientation assembly 150 is shown as preferably comprising one or more bottle spinning members 152 (e.g., belts or rollers) rotatably supported by an adjustable body 153 and driven via drive shaft 154 and motor 155. In a preferred arrangement, a vertical adjustment rod 157 is provided in the form of a threaded member which selectively interacts with one or more securing nuts 158 to enable custom adjustment of the vertical height of the assembly to accommodate varying bottle shapes and sizes. A pair of spaced pivot plates 160 interact with a relatively horizontal pivot shaft 161 to enable rotational and limited horizontal adjustment of body 153 and its supported bottle spinning member 152 (which might comprise one or more belts on rotating spools), with a pivot lock bar arrangement 163 provided for securing the assembly in an adjusted position. Lower mounting plate 165 can also be adjustingly mounted (e.g., via clamps, bolts or the like) adjacent tabletop 63 and/or upper frame member 62.

As will be understood, it is contemplated that a bottle partially nested within recess 43 of the cup assembly will be preliminarily engaged by an upper bottle cap support block 110, with cam plate 142' limiting the downward force imposed by the bottle top support assembly 102. In this way, rotation of bottle 12 relative to cup recess 43 can be accomplished by engagement of adjustable orientation assembly 150 with the preliminarily supported bottle 12. Rotation of the bottle (e.g., at least 360°) ensures interaction between detent 78 and recess 14, thereby assuring proper registration of the bottle within cup assembly 40. As rotating table 20 moves cup assembly 40 past orientation assembly 150, bottle top support assembly 102 disengages upper cam plate 142' and thereafter engages the upper portions of the bottle with full predetermined downward support force of compression spring 112.

To ensure proper registration of the oriented bottle, a position sensor (e.g., sensor 82 shown in FIG. 2) can be situated about the periphery of rotating table 20 to provide position feedback to the host computer 184, the programmable indexer 182 and/or any other appropriate control arrangements utilized. Particularly, the control devices of the present invention are contemplated as including an optical encoder linked to rotating table 20 which outputs a predetermined number of pulses (e.g., 80,000) for each revolution of the table. The encoder data stream can be separated into a plurality of channels which are phased and compared so that the programmable indexer 182 can recognize a number (e.g., 320,000) of distinct positions for each rotation of the table (20). The servo motor (e.g., 88) would also have a built-in predetermined resolution per revolution (e.g., 819,200), and the effective motor step to encoder step ratio (e.g., 1 to 1) can be determined (e.g., 819,200÷320,000 or 2.56 to 1) and preprogrammed into the indexer. The servo motor resolver feedback would ensure that the servo motor is exactly in the position that it should be, and feedback from the position sensor (e.g., 82) will provide a signal indicating whether the individual cups are in desired position as they pass the sensing point.

The indexer 182, being preprogrammed with the ratio of motor steps to encoder steps that it must follow to maintain a one to one rotational ratio, can also be preprogrammed to execute certain motion sequences. Each sequence can then be defined as a following ratio or percentage, and the indexer will then interpolate a new motor step to encoder step ratio to accomplish such ratio. For example, if it is desired to change from six (6) pinion rotations per table rotation to two (2), the gear (85) must follow the table 20 (in the same direction) at 66.67%. By constantly monitoring the incoming pulse train, that ratio is maintained regardless of the speed of table 20. The desired sequence or spin rate is user selected from the touchscreen interface 186.

Whenever an exact gear ratio is duplicated by the following procedure discussed above, the position of the cup assemblies 40 relative to table 20 should always repeat. Since the encoder pulse (being followed) is an exact multiple of the rotation rate of table 20 (320,000 positions per rotation of the table), there will always be an exact expected pulse count between input triggers (regardless of the speed or direction of gear 85). This expected count is related solely to how much of the table has passed between triggers. For example, if a small piece of reflective tape 45 is placed on every third cup (out of 30 total cup assemblies), the actual pulse count between triggers should be 320,000÷10 or 32,000 pulses (although every cup is repeating in front of the sensor, monitoring every third cup is sufficient to insure accurate repeating). It is this information that allows the system to detect even the slightest error, thus keeping the sensing mark 45 on the cups and the position sensor (e.g., 82) aligned, effectively duplicating an exact desired gear ratio.

In addition to the encoder that is linked to table 20, servo motor or drive 88 preferably has its own encoder built into it. This encoder has a resolution of, for example, 819,200 pulses per revolution. It uses the feedback from its own encoder to maintain accurate position. If the system senses an error, which will manifest as a slight difference between the number of pulses counted between triggers and the expected count (say 32,000), a slight adjustment in the speed ratio will be implemented. The amount of the correction is programmable, and can therefore be defined in the motion sequence so that the proportion of correction is appropriate. The amount of error (indicated by the encoder pulses) can be translated into a discreet distance. For example, an error count of 10 pulses may translate into 0.001 inches of error. Since the correction percentage is similarly related, it can also be defined as a distance (for example, 1% of correction may translate to 0.005 inches of correction). An appropriate correction (in percentage and/or distance) can therefore be calculated to adjust for each individual pulse of error encountered.

In this way, the indexer can be preprogrammed with appropriate information to compare the number of encoder pulses which should be received between successive sensing triggers, and if an error is detected, the system will adjust itself according to pre-programmed correction formulas provided in the indexer.

Returning now to FIG. 1, adjustability of the upper rotary table 100 is preferably provided via adjustment assembly 125, which comprises upper and lower support plates 126 and 128, respectively, connected via a plurality (preferably three) ballscrew rods 130. The threaded ballscrew rods 130 are preferably rotatably mounted in thrust bearings at the upper and lower support plates, and are threadably received in corresponding ballscrew nuts (132) fixed to upper rotary table 100. A pulley 134 is also shown as being attached for rotation with each ballscrew rod 130. It is contemplated that these pulleys might preferably be connected by an adjustment chain or belt (not shown) interconnecting all three pulleys for simultaneous movement. In this way, rotation of any one of the pulleys by manual or powered force would simultaneously rotate all of the ballscrew rods 130 for uniformly vertically adjusting plate 100. It is further contemplated that powered adjustment of plate 100 could easily be automated for preprogrammed adjustment between pre-set operating heights.

Figure 9:
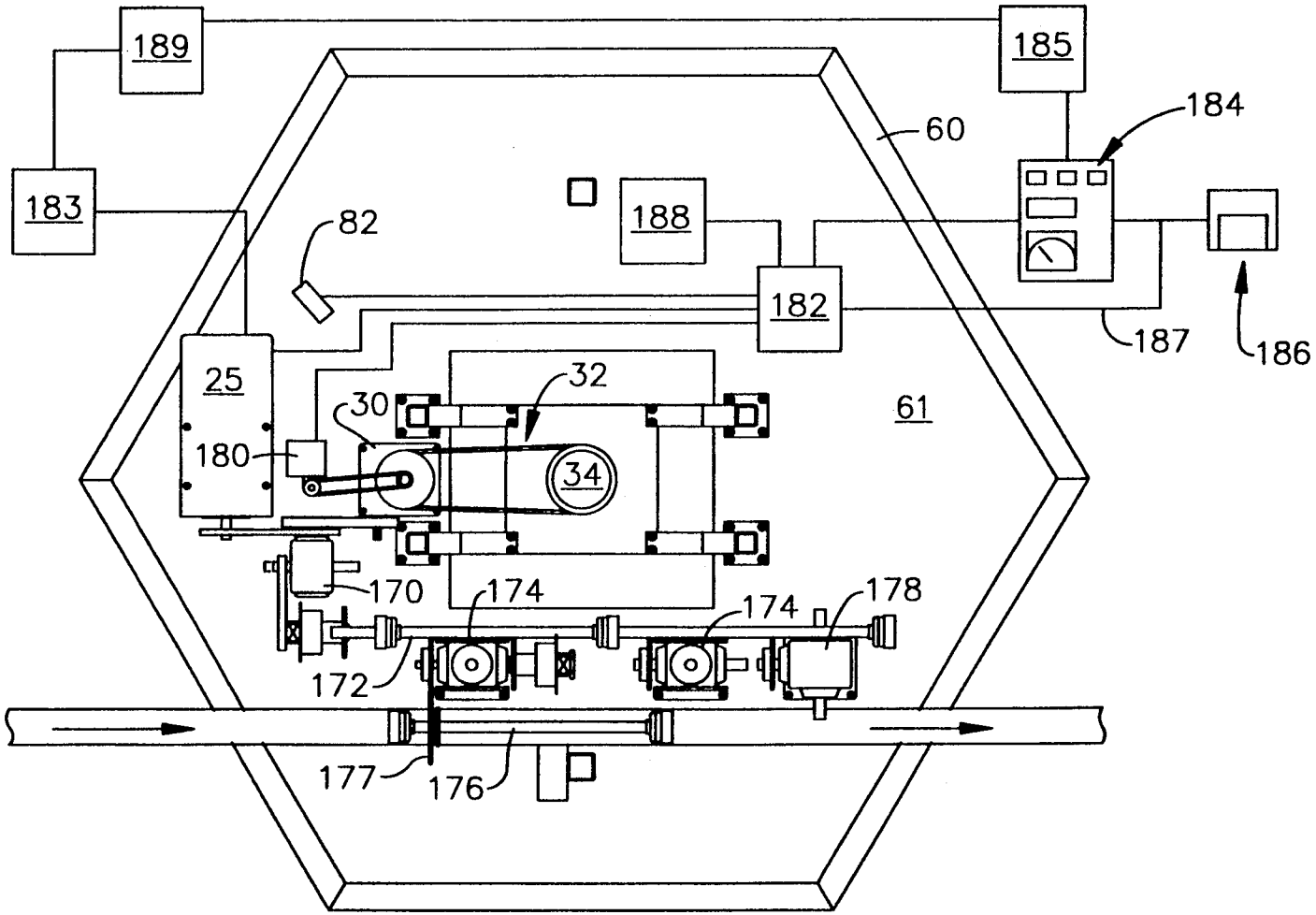
FIG. 9 is a schematic plan view of the base portions of the rotary labeling apparatus of FIG. 1, illustrating a preferred arrangement for interconnection of various driven parts of the subject rotary labeling apparatus.

Turning now to FIG. 9, a schematic top plan view of elements to be mounted adjacent the base or floor 61 of decorating machine 15 is illustrated. Particularly, it is preferred that main drive motor 25, which provides the rotary motion to drive collar 34 and drive shaft 26, may also be utilized to simultaneously provide powered movement to the bottle feeding and discharging conveyor systems which might advantageously be utilized in a continuous system. As will be understood, drive motor 25 is connected through gear box or transmission 30, through the pulley and belt drive arrangement 32, for rotation of drive shaft 26. As mentioned above, an optical encoder (e.g., encoder increaser 180) will preferably be linked to rotary table 20 for providing feedback on the position of the main drive and rotary table 20. A speed reducer/gear box 170 is also tied to the output of drive motor 25 to enable corresponding rotational movement of drive shaft 172 which transmits energy to the star wheel gear boxes 174. A belt connection might preferably similarly connect a screw feed conveyor drive shaft 176, and exit conveyor transmission 178 can be tied to drive shaft 172 as well. Such an integral arrangement not only efficiently utilizes the output of main drive motor 25 for a plurality of moving parts, but also can simplify synchronization of the various speeds of operation of these devices as the through put of the decorating machine is varied.

FIG. 9 also illustrates schematically the control interface and system interconnect for the labeling apparatus and method of the present invention. A touchscreen user interface or keypad 186 is provided for selection of the desired spin rate and labelling station displacement and operating parameters which can be imputed by an operator. Such commands are communicated to the host computer 184 and a programmable indexer 182 via a communication line such as an RS 232 port. Programmable indexer 182 also interfaces with the drive shaft encoder/increaser 180 for monitoring the movement and position of rotating table 20. Drive motor 25 is preferably powered by a motor control card 183 which utilizes two speed control potentiometers to vary the speed of table 20 (e.g., between high and low speeds) as desired.

As illustrated in FIG. 9, control card 183 is tied to programmable logic controller 185 via high/low speed relays 189. Programmable logic controller (PLC) 185 is also tied to host computer 184 via communication lines. In this way, computer 184 enables appropriate communication and exchange of information between indexer 182 and PLC 185, so that appropriate communications, feedback, and commands can be synchronized between servo drive 188 and main drive motor 25, as discussed herein. Computer 184 commands indexer 182 to implement certain pre-programmed spin rates or operating parameters including the follower program for servo drive 188 in order to implement desired effective gear ratios and spin rates.

Programmable indexer 182 also preferably receives input from the position sensor (e.g., 82) monitoring the position and orientation of the cup assemblies (40). Sensor 82 might be a photodetector arrangement which monitors cup positions by checking positions of reflective tape or similar marks placed on the cups. The programmable indexer provides a control signal (i.e., desired step rate) to the servo drive 188, which is connected to the motor leads to provide current according to the user program and the current feedback of the resolver position of the servo motor.

As indicated above, manipulation of the servo drive motor in this way effectively duplicates essentially any desired gear ratio between rotating table 20 and pinion gears 75 without a need for any physical alterations of the system. Moreover, the resulting system can repeat desired cup positions and spin rates in a reliable fashion previously unattainable in systems which required physical exchange of gears and machine parts. Similarly, at the touch of a button (e.g., via touchscreen 186) a user of the present system has the capability to alter the rotational displacement between labeling stations (e.g., 17 and 18). If it is desired, for example, to decorate a bottle 12 with both front and back labels (i.e., 180° displacement) first, then later run a bottle that requires body and neck labels aligned with each other (i.e., 360° displacement), the rotational differences required can be implemented as discussed above, and can be preprogrammed to be touchscreen selectable. In machines available heretofore, such a transition (if possible at all) would require either a change of gears and/or movement of the labelling stations relative to each other.

Having shown and described the preferred embodiments of the present invention, further adaptions of the continuous rotary labeling apparatus and method shown and described herein can be accomplished by appropriate modifications by one of ordinary skill in the art without departing from the scope of the present invention. Several of these potential modifications have been mentioned, and others will be apparent to those skilled in the art. Accordingly, the scope of the present invention should be considered in terms of the following claims and is understood not to be limited to the details of structure and operation shown and described in the specification and drawing.

We claim:

1. A rotary decorating machine for bottles or the like, said machine having at least one decorating station and further comprising:

a rotating table having a plurality of means for receiving a bottle to be decorated, said bottle receiving means spaced from one another adjacent the outer periphery of said table for rotatably moving received bottles past one or more decorating stations;

first means for rotatably driving said rotating table;

independently rotatable means attached adjacent a plurality of said bottle receiving means for receiving and holding the lower portions of a bottle to be decorated and for enabling planetary rotation of said bottles relative to said rotating table;

a lower gear rotatable independently of said rotating table;

second means for driving said lower gear independently of said rotating table, wherein said second means is directly connected to said lower gear;

a plurality of gears, each connected to one of said independently rotatable means and intermeshing with said lower gear, whereby rotation of said lower gear effects the rotation speed and direction of said bottle receiving means independently of rotation thereof with said rotating table; and control means for implementing instructions to said second driving means to control the rotation of said receiving and holding means relative to the rotation of said rotating table during operation.

2. The rotary decorating machine of claim 1, wherein said means for driving said lower gear comprises a servo motor.

3. The rotary machine of claim 2, wherein said plurality of gears are connected to said lower gear in overlapping, staggered relationship such that spacing between adjacent receiving and holding means can be minimized as desired.

4. The rotary machine of claim 1, further comprising means for monitoring the rotational movement of said rotating table and means for adjusting rotational movement of said lower gear in conjunction with rotational movement of said rotating table as desired.

5. The rotary machine of claim 4, wherein said means for monitoring comprises an encoder, and wherein said adjusting means comprises an indexing device which utilizes information from said encoder.

6. The rotary decorating machine of claim 1, further comprising an upper rotating table having a plurality of bottle support devices spaced radially adjacent its outer periphery, said support devices each being substantially aligned with a bottle receiving means therebelow and extending downwardly to selectively fit over the upper portions of a bottle to be decorated, whereby said aligned support device and said bottle receiving means maintain a bottle in substantially upright position at one or more of said decorating stations.

7. The rotary decorating machine of claim 1, wherein said bottle receiving means each comprise a cup-like recess for receiving the lower portions of a bottle.

8. The decorating machine of claim 7, wherein said bottle receiving means each further comprises alignment means for ensuring a predetermined registration orientation of a bottle.

9. The decorating machine of claim 8, wherein said alignment means comprises a biased detent which corresponds with an alignment structure on the bottle to maintain the bottle in predetermined orientation within said cup-like recess.

10. The decorating machine of claim 9, further comprising means for rotatably orienting a bottle within said cup-like recess to align said detent and said alignment structure after a bottle is placed at least partially within said cup-like recess.

11. The decorating machine of claim 10, wherein said orienting means comprises an adjustable assembly located adjacent said outer periphery of said rotating table, said assembly comprising a rotatable member which selectively contacts bottles as they pass by said orienting means as said rotating table is rotated, said contact providing a predetermined amount of rotation to said bottle relative to the cup-like recess and aligning said detent with an alignment structure of said bottle.

12. The decorating machine of claim 6, wherein said second driving means comprises a rotary drive assembly with a drive member extending substantially coaxially with said servo motor.

13. The decorating machine of claim 1, wherein said first and second drive means are mechanically independent of one another.

14. A servo drive arrangement for a rotary decorating machine for bottles having an alignment recess or structure formed therein, said drive arrangement comprising:

a rotatable table having an outer periphery;

a servo drive arrangement arranged for directly rotatably driving said rotatable table;

a plurality of bottle receiving locations spaced adjacent the outer periphery of said rotatable table for rotation therewith, each such location further comprising an independently rotatable means for receiving and holding the lower portions of a bottle to be decorated;

a lower gear mounted for rotation independent of said rotatable table;

second means for selectively driving said lower gear independently of said rotatable table, wherein said second means is directly connected to said lower gear;

a plurality of pinion gears, each respectively connected to a particular receiving and holding means for rotation with said lower gear, whereby rotation of said lower gear enables control of the rotation speed and direction of said receiving and holding means independently of rotation of the pinion gears in a planetary fashion with said rotatable table; and means for implementing instructions to said second driving means to control the rotation of said receiving and holding means relative to the rotation of said rotating table during operation.

15. The servo drive arrangement of claim 14, further comprising means for controlling rotation of said lower gear relative to said rotatable table in operation, whereby any of a plurality of different effective ratios of rotation can be automatically and selectively provided between said rotatable table and said lower gear without altering the structural arrangement.

16. The servo drive arrangement of claim 15, wherein said controlling means comprises an encoder connected to said rotatable table and an indexing device connected to said servo drive.

17. The servo drive arrangement of claim 16, further comprising a sensing device for selectively monitoring the position of successive receiving and holding means as said table is rotated, said sensing device being connected with said controlling means to enable correction of such monitored position as appropriate.

18. A method for substantially continuously labeling bottles having an alignment recess or structure for establishing orientation thereon, said method comprising the following steps:

providing a labeling machine having at least one decorating station located adjacent a rotating table having a plurality of means for receiving bottles to be decorated spaced from one another adjacent the outer periphery thereof, first means for rotatably driving said rotating table, a plurality of independently rotatable means for receiving and holding the lower portions of a bottle to be decorated, a lower gear rotatable independently of said rotating table, second means for driving said lower gear independently of said rotating table, wherein said second means is directly connected to said lower gear, a plurality of planetary gears, each connected to a particular receiving and holding means and said lower gear, and a means for implementing instructions to said second driving means to control the rotation of said receiving and holding means relative to the rotation of said rotating table during operation;

rotating said rotating table to successively more a plurality of bottles to be decorated past said decorating station; and rotating said lower gear to control the rotation speed and direction of said receiving and holding means independently of planetary rotation thereof with said rotating table.

19. The method of claim 18, wherein said rotation table is rotated at a substantially constant speed, and rotation of bottles adjacent said decorating station may be selectively provided at a speed different than said constant speed by appropriate rotation of said lower gear.

20. The method of claim 18, further comprising the step of providing an upper rotating table having a plurality of bottle support devices spaced from one another adjacent its outer periphery, said support devices substantially aligned with a receiving and holding means therebelow and extending downwardly to selectively fit over the upper portions of a bottle to be decorated, whereby said aligned support device and receiving and holding means maintain a bottle in substantially upright position at said decorating station.

21. The method of claim 20, wherein said bottle support devices are downwardly biased, and further comprising the step of selectively limiting the downward bias of said bottle support devices to facilitate rotational orientation of a bottle within a receiving and holding means.

22. The method of claim 18, wherein said receiving and holding means each comprise a cup-like recess for receiving the lower portions of a bottle and a biased bottle detent, and comprising the step of rotatably orienting a bottle within said cup-like recess to align said detent and said alignment recess after a bottle is placed at least partially within said cup-like recess.

23. The method of claim 18, further comprising the steps of monitoring the rotational movement of said rotating table and controlling the rotational speed and direction of said lower gear in response to said monitored movement in order to provide a desired rotational movement of said receiving and holding means.

24. The method of claim 23, further comprising the steps of sensing the rotary position of individual receiving and holding means at a predetermined position in said labeling machine, comparing such sensed position to a predetermined desired position, and implementing corrective positioning via rotation of said lower gear as required.

25. The method of claim 23, wherein the step of monitoring is accomplished through the use of an encoder linked to said rotary table, and wherein information from said encoder is utilized by an indexing device connected to said second driving means to ensure accurate control of the rotation of said lower gear, whereby altering the rotation of said lower gear relative to the rotation of said rotary table correspondingly alters the effective gear ratio between said rotary table and lower gear combination.

* * * * *

UNITED STATES PATENT AND TRADEMARK OFFICE

CERTIFICATE OF CORRECTION

PATENT NO. : 5,259,913

DATED : Nov. 9, 1993

INVENTOR(S) : Jeffrey D. Stover

It is certified that error appears in the above-identified patent and that said Letters Patent is hereby corrected as shown below:

Col. 14, line 43, "more" should be --move--,

Signed and Sealed this

Seventh Day of June, 1994

Bruce Lehman

*Attest:*

BRUCE LEHMAN

*Attesting Officer*

*Commissioner of Patents and Trademarks*